US007101219B1

(12) United States Patent
Huang

(10) Patent No.: US 7,101,219 B1
(45) Date of Patent: Sep. 5, 2006

(54) ADAPTOR WITH REFLECTION FINS

(76) Inventor: Huang-Chou Huang, No. 377, Fu-Teh First Rd., Hsi-Chih, Taipei Hsein (TW)

( * ) Notice: Subject to any disclaimer, the term of this patent is extended or adjusted under 35 U.S.C. 154(b) by 0 days.

(21) Appl. No.: 11/311,536

(22) Filed: Dec. 20, 2005

(51) Int. Cl.
*H01R 3/00* (2006.01)

(52) U.S. Cl. ..... 439/490

(58) Field of Classification Search ..... 439/490
See application file for complete search history.

(56) References Cited

U.S. PATENT DOCUMENTS 5,704,802 A * 1/1998 Loudermilk ..... 439/676
6,328,595 B1 * 12/2001 Chang ..... 439/490
6,361,357 B1 * 3/2002 Stillwell et al. ..... 439/490
6,478,611 B1 * 11/2002 Hyland ..... 439/490
6,537,110 B1 * 3/2003 Korsunsky et al. ..... 439/676
6,957,982 B1 * 10/2005 Hyland et al. ..... 439/490
2003/0211782 A1 * 11/2003 Esparaz et al. ..... 439/620
2005/0136731 A1 * 6/2005 Brown et al. ..... 439/490

* cited by examiner

*Primary Examiner*—Briggitte R. Hammond
(74) *Attorney, Agent, or Firm*—Posz Law Group, PLC; R. Eugene Varndell, Jr.

(57) ABSTRACT

An adaptor with reflection fins has a seat and a shell. A first channel is defined in a center of the seat. Two slots are respectively defined in two opposed front ends of the body and two inclined holes are defined in an interior of the slots. Two LEDs are respectively mounted in lower ends of the slots. Two light conducting flats are respectively mounted in top ends of slots. The shell is sleeved with the seat and two openings are defined in two opposed front ends of the shell. Two reflection flats respectively have a first fin and a second fin inclined to and connected to the first fin, a first lug is mounted on the second fin, whereby the first lugs are respectively inserted into the openings. Hence, the light via the light conducting plates achieves a high reflection effect.

3 Claims, 4 Drawing Sheets

ADAPTOR WITH REFLECTION FINS

BACKGROUND OF THE INVENTION

1. Field of the Invention

The present invention relates to an adaptor, and more particularly to an adaptor with reflection fins.

2. Description of Related Art

With the quick development of computers, all kinds of adaptors with different functions are on the market, such as the adaptor which can connect the computer and its peripheral devices (such as telephones, earphones, microphones or speakers). Such a plug may be inserted in and removed from the respective sockets many times whereby fine contact strips and other elements therein may be damaged. Minor fluctuations in transmission of data may be very serious, especially when inconspicuous due to being intermittent. Furthermore, the status of the adaptor can not be distinguished from its appearance. Hence, a first conventional adaptor has at least one LED (Light Emitting Diode), light of which is conducted via a transparent plate to a visible surface to enable a user to discriminate the operational status of the adaptor. However, because of the light being refracted for at least one time and becoming diffused, the strength and the range of the light are reduced thereby limiting the practicality of the device. A second conventional adaptor comprises a shell securely sleeved with an electrical circuit, and a plug provided in a front end of the shell. An L-like light conducting member, which has a top foot mounted in a top end of the shell and a bottom foot mounted in a bottom end of the shell, is provided on the shell so that the light from the electrical circuit is conducted via the conducting member to a visual surface. However, it is difficult for the user to provide the light conducting member on the shell and the light is diminished in an interior of the L-like light conducting member.

Therefore, the invention provides an adaptor with reflection fins to mitigate or obviate the aforementioned problems.

SUMMARY OF THE INVENTION

The main objective of the present invention is to provide an adaptor with reflection fins, which it is easy to assemble and which conducts light in a highly efficient manner.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
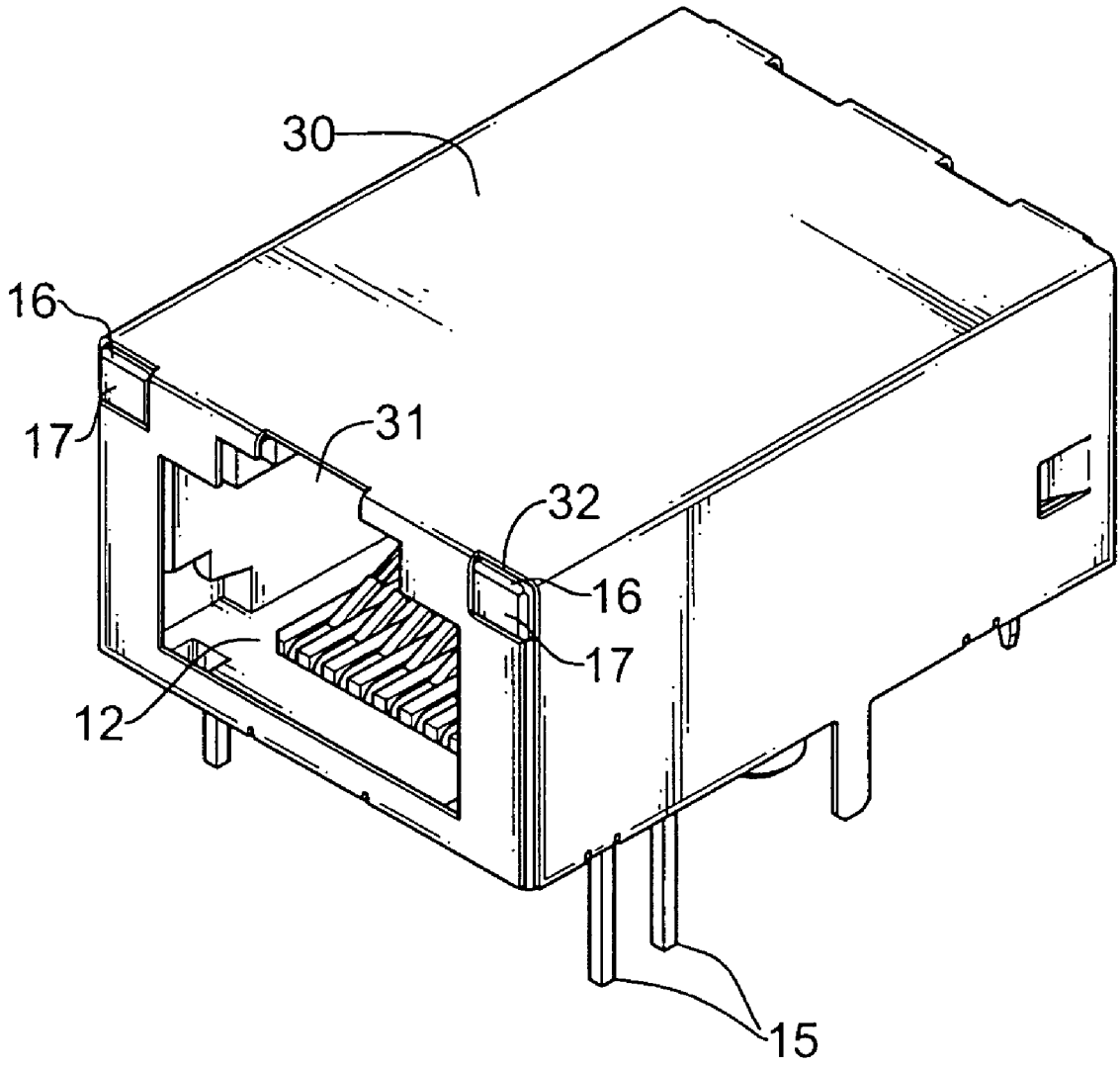
FIG. 1 is a perspective view of an adaptor with reflection fins in accordance with the present invention.
Figure 2:
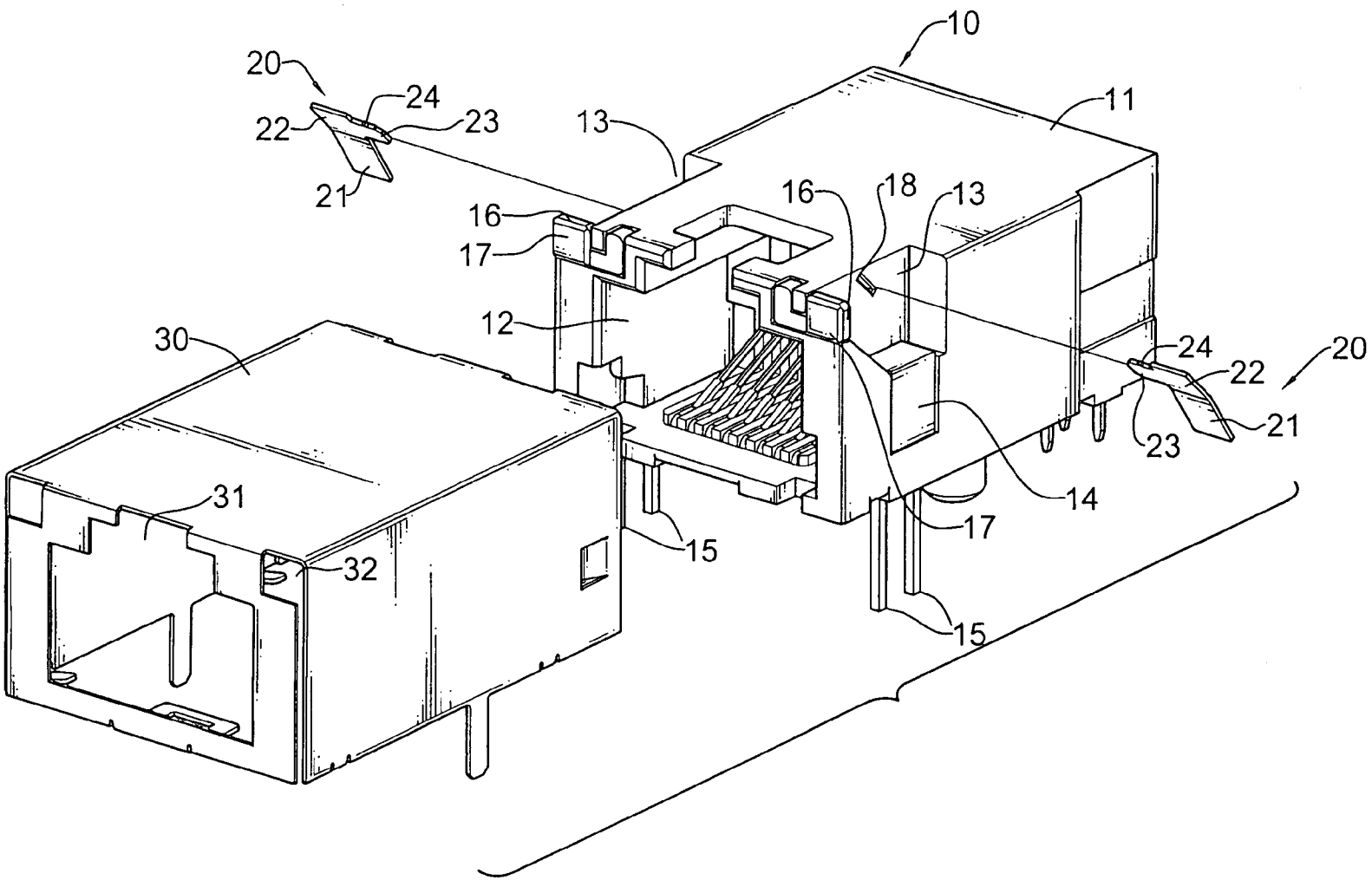
FIG. 2 is an exploded perspective view of the adaptor with the reflection fins in accordance with the present invention.

With reference to FIGS. 1–2, an adaptor with reflection fins comprises a seat (10) and a shell (30).

The seat (10) is composed of a body (11) made of plastic material, a first channel (12) defined in a center of the body (11), and two symmetrical slots (13) respectively defined in a front top end of the body (11).

Two LEDs (Light Emitting Diode) (14) are respectively provided in lower ends of the slots (13) and multiple terminals (15) in a row are respectively and downwardly extended out of a lower end of the LED (14) and a lower end of each terminal (15) is electrically connected to an electrical circuit (not shown in figures).

Two transparent light conducting plates (16) are respectively provided in front ends of the slots (13) and two translucent plates (17) respectively abut the light conducting flats (16). Two holes (18) each with an angle relative to the slot (13) are respectively defined in two interior walls defining the slots (13).

Two reflection flats (20) made of metallic material are respectively inserted into the slots (13). Each reflection flat (20) has a first fin (21) and a second fin (22) connected to and inclined to the first fin (21). A first lug (23) is mounted on each second fin (22) and a second lug (24) is integrally formed on an edge of each second fin (22) and abuts the first lug (23). When each second lug (24) is inserted into the respective hole (18), each first lug (23) is securely mated with the slot (13) so that the reflection flats (20) are respectively mounted on the body (11).

Figure 3:
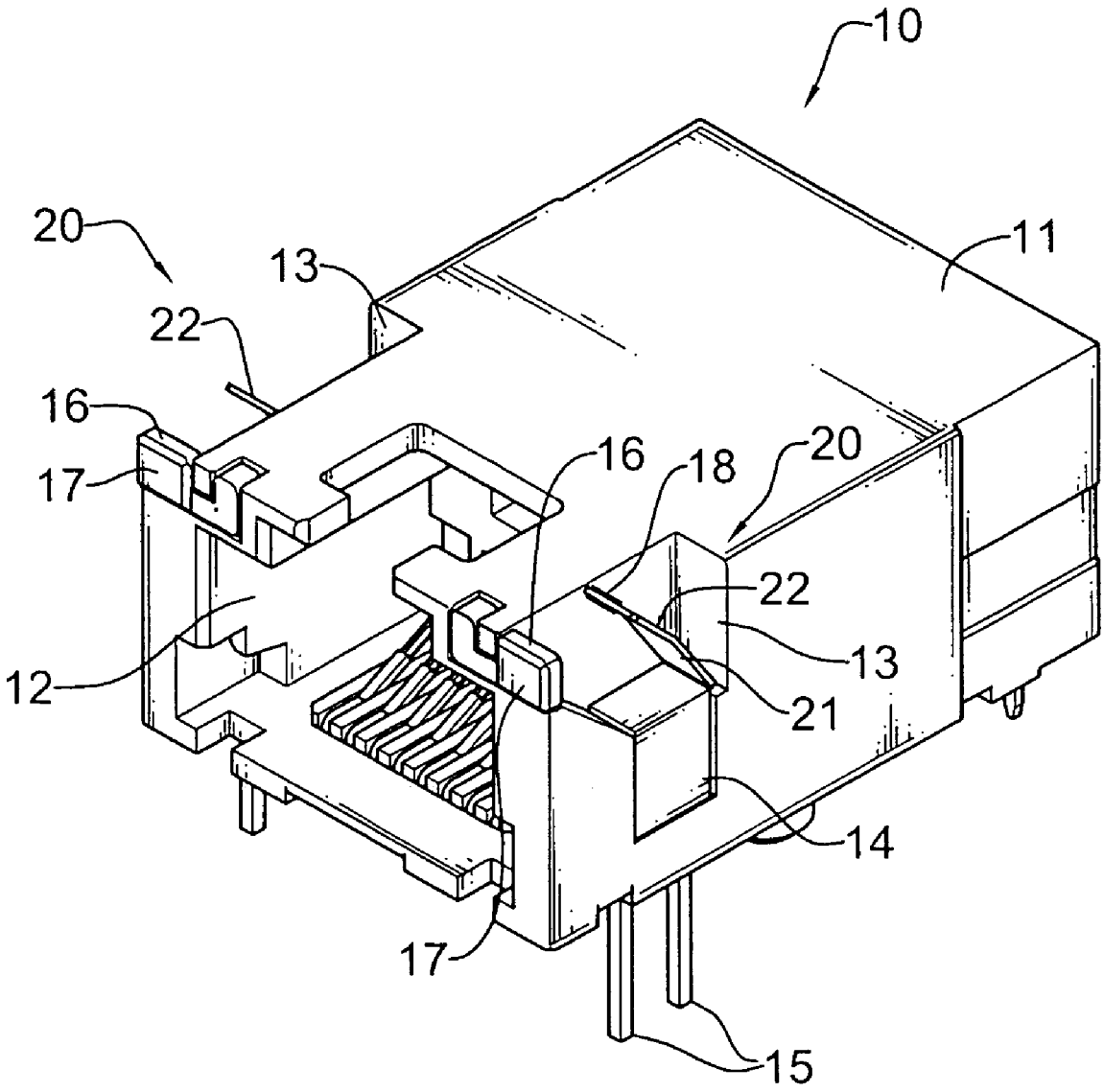
FIG. 3 is a perspective view of a seat of the adaptor with the reflection fins in accordance with the present invention.
Figure 4:
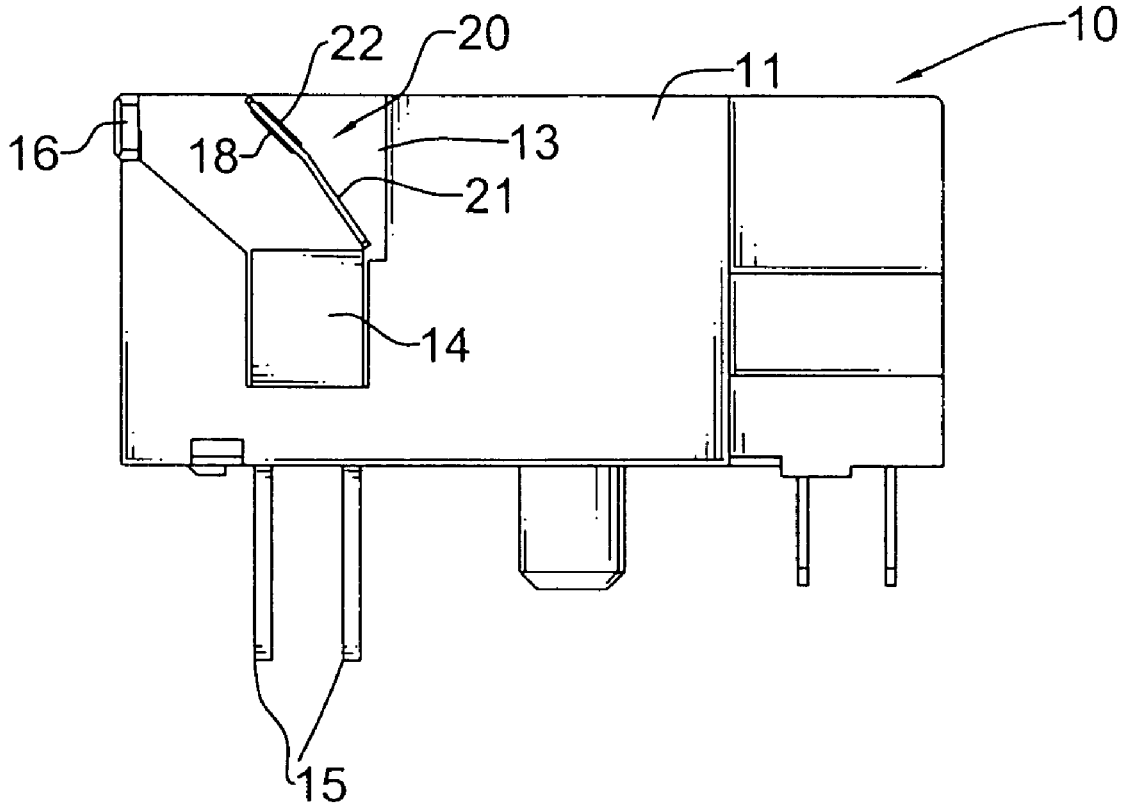
FIG. 4 is side view of seat of the adaptor with the reflection fins in accordance with the present invention.

With reference to FIGS. 1, 3 and 4, the seat (11) is inserted into the shell (30) and the multiple terminals (15) in the row are electrically connected to an electrical power supply. When the LEDs (14) are lit, the light is reflected via the first and the second fins (21, 22) and crosses the translucent flat (17) to be seen through the openings (32). Hence, the light effect is high and with the simple configuration, the present invention is easy to assemble.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An adaptor with reflection fins comprising:

a seat (10) having a body (11) and a first channel (12) defined in a center of the body (11), two slots (13) respectively defined in two opposed front ends of the body (11) and having two inclined holes (18) respectively defined in an interior of the slots (13);

two LEDs respectively mounted in a lower end of the slots (13) and multiple terminals (15) in a row extending outwardly and downwardly of lower ends of each LED; two light conducting flats (17) respectively mounted in top ends of slots (13);

a shell (30) sleeved with the seat (10) and having a second channel (31) defined in a center thereof and two openings (32) respectively defined in two opposed front ends of the shell (30); and two reflection flats (20) each having a first fin (21), a second fin (22) inclined to and connected to the first fin (21), a first lug (23) mounted on the second fin (22), a second lug (23) is respectively inserted into the inclined holes (18).

2. The adaptor with reflection fins as claimed in claim 1, wherein each second lug (24) is respectively and integrally formed on the second fins (22) and abut the first lugs (23), whereby each second lug (24) is securely mated with the hole (18) to fasten on the body (11).

3. The adaptor with reflection fins as claimed in claim 1, wherein two translucent flats (17) respectively abut to and are mounted in front ends of the light conducting flats (16).

* * * * *